US006080907A

United States Patent [19]

Miller

[11] Patent Number: 6,080,907

[45] Date of Patent: Jun. 27, 2000

[54] AMMONIA FLUIDJET CUTTING IN DEMILITARIZATION PROCESSES USING SOLVATED ELECTRONS

[75] Inventor: Paul L. Miller, Harvest, Ala.

[73] Assignee: Teledyne Commodore, L.L.C., Huntsville, Ala.

[21] Appl. No.: 09/066,689

[22] Filed: Apr. 27, 1998

[51] Int. Cl.[7] ..... A62D 3/00; B08D 9/00

[52] U.S. Cl. ..... 588/202; 588/203; 134/22.1; 134/22.12; 134/22.13; 134/167 R; 134/172

[58] Field of Search ..... 588/202, 203; 149/124; 134/22.1, 22.12, 22.13, 172, 167 R

[56] References Cited

U.S. PATENT DOCUMENTS

| | | | |
|---|---|---|---|
| 1,492,922 | 5/1924 | Knight | 134/167 R |
| 3,440,096 | 4/1969 | Scott | 134/167 R |
| 4,111,490 | 9/1978 | Liesveld | 299/17 |
| 4,853,040 | 8/1989 | Mazur et al. . | |
| 4,854,982 | 8/1989 | Melvin et al. . | |
| 5,110,364 | 5/1992 | Mazur et al. . | |
| 5,175,022 | 12/1992 | Stout et al. . | |
| 5,284,995 | 2/1994 | Melvin | 588/203 |
| 5,363,603 | 11/1994 | Miller et al. | 451/40 |
| 5,414,200 | 5/1995 | Mouk et al. . | |
| 5,495,062 | 2/1996 | Abel . | |
| 5,516,968 | 5/1996 | Abel . | |
| 5,516,970 | 5/1996 | Miller et al. | 588/202 |
| 5,613,238 | 3/1997 | Mouk et al. . | |
| 5,737,709 | 4/1998 | Getty et al. | 588/202 |

FOREIGN PATENT DOCUMENTS

| | | | |
|---|---|---|---|
| 1337902 | 1/1996 | Canada . | |
| 2-59361 | 2/1990 | Japan . | |
| 9718858 | 5/1997 | WIPO | A62D 3/00 |
| WO 97/18858 | 5/1997 | WIPO . | |

*Primary Examiner*—Steven P. Griffin
*Assistant Examiner*—Eileen E. Nave
*Attorney, Agent, or Firm*—Smith Gambrell & Russell, LLP

[57] ABSTRACT

Methods of cutting structural shapes by impinging a high pressure jet of anhydrous liquid ammonia or anhydrous ammonia-abrasive mixture at high impact velocity at a target substrate for faster, more efficient cutting/penetration rates i.e., up to 25 percent improvement over high pressure jet cutting methods with water as the cutting fluid, provide greater safety and flexibility, particularly in demilitarizing munitions comprising energetic materials and/or chemical warfare agents. The energy from the cutting jet comprising anhydrous ammonia may also be utilized in a continuous, uninterrupted sequence of processing steps after penetrating a closed casing for dispersing/dissolving and washing out the contents from the penetrated containment for further processing. The methods include treating the slurries comprising the removed hazardous substances with solvated electrons to chemically reduce and destroy virtually any hazardous or toxic substance, and particularly chemical warfare agents and energetic materials.

74 Claims, 3 Drawing Sheets

AMMONIA FLUIDJET CUTTING IN DEMILITARIZATION PROCESSES USING SOLVATED ELECTRONS

TECHNICAL FIELD

The present invention relates to the discovery that anhydrous liquid ammonia provides a more efficient fluid for high pressure fluid jet cutting operations making it especially advantageous in the demilitarization of munitions, and in particular, as an initial step in accessing chemical warfare agents and energetic materials for treatment in powerful metal reduction reactions featuring solvated electrons.

BACKGROUND OF THE INVENTION

The world's stockpile of munitions have several driving reasons for their safe and efficient destruction. These reasons vary from the obvious need for arms reduction since the end of the Cold War, to treaty obligations, the high cost of secure storage, to public risk near the storage locations, and to the fact that chemical munitions are slowly degrading. The degradation problem has become so bad that almost 6% of the items processed at the Army's destruction facility can not be processed with existing technologies. In addition, these munitions are potentially dangerous as the toxic nerve agents have corroded their containers and infiltrated the enclosed explosive bursters assembled within the weapons. This problem has become serious enough that the US Army's studies on chemical agent rockets have predicted that within the next few decades the units may auto-ignite due to degradation of internal stabilizers.

The conventional methods of accessing the munitions in this condition are inefficient at best, and dangerous at worst. Besides the previously mentioned 6%+ or more failure rate experienced by the Army using existing technology, more than three of the limited number of chemical munitions demilitarized have exploded during disassembly. Clearly the use of the current mechanical disassembly processes are both dangerous and inefficient.

An alternative munition accessing method that has had much publicity is the use of liquid nitrogen to chill the munitions below their brittle transition temperature and then to fracture the components into small pieces. Unfortunately, the massive volumes of liquefied nitrogen required and the length of time necessary to adequately chill the munitions preclude the process from being efficient. In addition, this process has also experienced an explosion during operation leaving some serious doubt about the process' safety.

One might conclude that use of high pressure waterjets would be the safest system for cutting casings as an initial step in the demilitarization of munitions. Unfortunately however, the chemical agents and explosives used by the militaries of the world are typically hydrophobic materials, like oils, that do not mix appreciably with water. Experience has shown that when a waterjet is used on explosives, a thick emulsion is formed that severely complicates further processing. An example of emulsions formed by water and hydrophobic oils is common mayonnaise, which closely resembles the explosive/water or chemical agent/water emulsions.

Besides being almost impossible to pump efficiently, such emulsions have other severe disadvantages. Many of the military energetics are still dangerous in their water emulsion form. This characteristic is heavily exploited by the commercial explosive industry where emulsion explosives are commonly used materials for rock blasting. The pumping of explosive emulsions increases the danger to plant operations because the emulsions plug piping, deposit explosives throughout the plant piping, and can easily propagate an explosion from one part of the plant throughout the rest of the facility. Finally, the use of water to form explosive or chemical agent emulsions reduces the effectiveness of the decontamination materials as the emulsions form stable droplets that restrict the diffusion of the decontamination chemistries to their targets.

Alternative fluids to water have been suggested in connection with specialty fluidjet cutting operations. In this regard, hydrocarbon solvents may be used when highly reactive alkali metals, like lithium or sodium are being processed.

U.S. Pat. Nos. 4,854,982 (Melvin et al I) and 5,284,995 (Melvin et al II) disclose pressurized anhydrous liquid ammonia in demilitarization procedures. More specifically, Melvin et al (I) disclose methods for demilitarization of rocket motors containing solid and ground composite propellant comprising ammonium perchlorate oxidizer and other miscellaneous ingredients. The propellant composition is removed by mean of a spinning spray type nozzle which discharges pressurized anhydrous ammonia directly into the interior of open rocket motor cases to erode or reduce the propellant to small particles. A slurry mixture accumulates in the rocket motor casing consisting of dissolved oxidizer and other residual propellant ingredients as insolubles. The slurry is further treated, e.g., by filtration. Recovery of the oxidizer occurs when the ammonia is allowed to gasify causing the ammonium perchlorate to drop out of solution. The ammonia used in the wash out process is dried and recompressed for reuse in the process.

Melvin et al (II), as in the case of Melvin et al (I), also employs a pressurized spray of anhydrous liquid ammonia, but they use it to extract and recover nitramine type oxidizers from solid rocket propellants, in particular, those known as "HMX" and "RDX", or cyclotetramethylenetetranitramine and cyclotrimethylenetrinitramine, respectively. Melvin et al (II) employs a sequence of steps for rocket motor demilitarization by propellant extraction, separation and recovery. They begin with the direct removal of the solid propellant. One method used is mechanical cutting and comminution and/or liquid jet ablation with pressurized ammonia spray nozzles. Alternatively, a comminution fixture may be used with pressurized liquid ammonia spray. In either embodiment, the spray nozzle or comminution fixture is placed in the interior of an open rocket motor and pressurized ammonia discharged against the propellant. The solid propellant is fractured or comminuted, reduced to smaller particles and removed from the motor in the form of a slurry for further treatment.

Melvin et al (II) also disclose bulk propellant from sources other than rocket motors macerated in a dedicated pressure vessel. In this embodiment, chips of propellant can be further treated by spraying the interior of the pressure vessel with a high pressure ammonia jet pre-treatment before introducing the material into an extractor/separator system.

While the methods of Melvin et al (I) and (II) are useful in the removal and recovery of chemical propellant from rocket motors, their methods have limited applications because they are dependent on a suitable access opening in the munition, such as a rocket nozzle or port, or at least partial disassembly of the munition in order to introduce the required ammonia spray nozzle or modified fixture for direct spraying of the propellant. The disadvantage of such methods is that to access an otherwise closed casing or containment for demilitarization by interior spraying, disassembly or other processing of the munition is required. However, disassembly is a slow, inefficient process, and therefore, non-economic. More importantly, mechanical disassembly of munitions is hazardous. For example, an M55 rocket is a chemical warfare munition containing approximately 10 pounds of highly toxic nerve agent, more than 2 pounds of dangerous explosives and about 19 pounds of reactive rocket propellant. Various systems for cutting casings of munitions have been tested including the use of commercial waterjets. In addition to the reasons outlined above concerning the potential hazards associated with aqueous emulsions of chemical agents and energetics, their extraction, recovery and recycling from aqueous effluents has also proven to be economically unattractive.

While the methods of Melvin et al (I) relate to the recovery of propellants, and Melvin et al (II) also relates to recovery and in some instances to the destruction of select high energy ingredients with ammonia, neither of the Melvin et al patents teach or suggest methods which will be suitable for the destruction of all or virtually all classes of hazardous substances, particularly energetics and chemical warfare agents, using protocols that are fully compatible with ammonia-containing effluents.

Accordingly, there is a need for more efficient, cost effective methods with an improved margin of safety for the demilitarization of munitions and ordnance, and in particular all classes of chemical warfare agents, energetic materials, and combinations thereof, as well as most other hazardous chemical substances, and substrates contaminated with hazardous materials. Such methods should include the preliminary step of accessing interiors of containments for the above substances and substrates by means of high pressure fluidjet cutting with a liquid capable of providing improved cutting efficiency, and which is fully compatible with process steps, as may be needed, in demilitarization and chemical decontamination protocols.

SUMMARY OF THE INVENTION

The present invention is based on the recognition that anhydrous liquid ammonia is a highly satisfactory solvent for a great many hazardous chemical substances. For example, anhydrous ammonia is an effective solvent for practically all of the nitroaromatics, the principal structure of military explosives. It is also compatible with many propellants, flammables and combustibles, i.e., energetic materials. In addition, ammonia is an excellent solvent for many chemical agents used by the military. Importantly, most solutions of energetics and ammonia are non-propagating and are quite stable. Such properties allow many energetics, and other hazardous chemical substances to be safely transported without coating piping systems, thereby avoiding the propagation of an explosive event through the system.

This invention is also prefaced on the surprising discovery that a high pressure fluidjet cutting system employing anhydrous ammonia as an alternative cutting fluid is capable of providing up to about a 25 percent increase in cutting efficiency over that of a high pressure waterjet operating at the same conditions. This may possibly be due in part to its very low boiling point (−33° C.). It was found that a high pressure fluidjet of anhydrous ammonia rapidly chills down the metal of a containment vessel, for example, causing embrittlement, and more rapid erosion of the target at the cutting site for enhanced cutting rates.

In addition to more efficient cutting/penetration of containments with high pressure, high velocity ammoniajet or abrasive-ammoniajet cutting fluid mixtures for access to the containment interior and its contents, the same high pressure cutting jet entering a containment after break through of its outer casing performs by immediately eroding and washing out all hazardous material from the interior. In so doing a mixture is generated in the form of an ammonia-containing slurry comprising the hazardous material, which slurry possesses a higher margin of safety for transporting for further treatment, and so forth.

The invention is also based on the discovery that all or virtually all classes of hazardous chemical substances, and especially substances known or classified as chemical warfare agents and energetics, can be readily and economically destroyed or degraded by forming reaction mixtures with the (i) ammonia-containing slurries of hazardous substance(s) washed from containments and (ii) solvated electrons, followed by reacting the mixtures.

Significantly, the processes of this invention are based on the trifunctionality of anhydrous liquid ammonia performing as (i) high energy, improved efficiency cutting fluids for accessing the interior of target substrates; (ii) as power jets for solvating the contents of target substrates and for removal by "pumping" slurries comprising the hazardous contents from the target substrate, and (iii) as a reaction medium wherein the ammonia-containing slurry comprising the hazardous substance is chemically destroyed usually through a reduction mechanism with solvated electrons. The destruction phase is highly compatible with the above accessing/cutting and/or slurrying and washout phases because solvated electrons are preferably formed by dissolving an alkali metal or alkaline earth metal in a nitrogen-containing base, like anhydrous liquid ammonia. Hence, the slurries and solutions of hazardous substances which share a common solvating liquid, namely anhydrous ammonia, readily mix and react with the electrons also solvated in ammonia to destroy the hazardous substances.

It is therefore one principal object of the invention to provide methods for destroying or degrading virtually any hazardous substance which may be confined in a containment, i.e., "target substrate", which comprises the steps of:

(i) providing a system suitable for impinging a high pressure jet of a liquid from a cutting head onto a target substrate at sufficient velocity to disperse or dissolve the hazardous substance(s);

(ii) positioning in a work area the target substrate adjacent to the cutting head of the system;

(iii) shielding the target substrate and cutting head from the work area;

(iv) impinging a high pressure jet comprising anhydrous liquid ammonia from the cutting head to form an ammonia-containing slurry or solution of the hazardous substance, and (v) forming a reaction mixture comprising the ammonia-containing slurry or solution of the hazardous substance (s) with solvated electrons, and reacting the reaction mixture.

While the invention contemplates conducting the destruction phase reaction in the native container holding the hazardous material wherein the material has been slurried or dissolved, the reaction is preferably conducted outside the containment of the target substrate in a dedicated reactor for such reactions.

As a further embodiment of the above stated invention the high pressure cutting liquid is more than an ammoniajet, but comprises a jet stream in the form of a composition comprising at least anhydrous liquid ammonia and an abrasive for even more efficient cutting of the containment of the target substrate. The ammonia performs as a carrier for the abrasive. The anhydrous ammonia-abrasive mixtures may also contain other additives, e.g., surfactants, familiar to those skilled in the art.

The expression "destroying", "destruction", "degrading" and other similar expressions as appearing in the specification and claims herein is intended to mean any target substrate or hazardous substance contained therein, which is transformed into a less hazardous substance, product or article of manufacture in practicing the methods of the invention.

The expressions "shield", "protective chamber" or variations thereof appearing herein and in the claims are intended to include hoods, encasements, pressure vessels and other enclosures and devices, which may optionally have suction and venting means, all for capturing, withdrawing and/or treating any fugitive ammonia fumes, other reactant and reaction by-products in practicing the methods disclosed herein which might otherwise enter the environment of the work area.

Solvated electron chemistry, including methodologies in forming and using solvated electrons in the destruction of hazardous substances is described in detail in several patents assigned to Commodore Applied Technologies, Inc., including U.S. Pat. Nos. 4,853,040 and 5,110,364; Canadian Pat. 1,337,902 and in Japanese Pat. 2,590,361. Other patents have issued relating to the use of anhydrous liquid ammonia alone, and optionally in dissolving metal reactions in forming solvated electrons for the treatment of soil contaminated with radionuclides, hazardous non-radioactive metal ions and mercury metal, including mixed wastes, containing one or more of the above, plus pesticides, PCBs, chlorinated dioxin, to name but a few. The foregoing processes relating to the decontamination of soil with ammonia alone, and optionally with solvated electrons are disclosed in U.S. Pat. Nos. 5,495,062; 5,516,968 and 5,613,238. U.S. Pat. No. 5,414,200 further discloses the use of anhydrous ammonia alone, and optionally solvated electrons in the destruction of environmentally harmful CFCs wherein the solvated electrons are formed by dissolving substoichiometric equivalents of reactive metals, preferably in anhydrous ammonia. PCT International publication No. WO 97/18858, published May 29, 1997, to Commodore Applied Technologies, Inc., discloses methods and a system for the destruction of chemical warfare agents when chemically reacted with anhydrous ammonia alone, or with solvated electrons formed by dissolving an active metal, like sodium in anhydrous liquid ammonia.

It is yet a further object of the invention to provide a method for accessing the interior of a closed containment with a more efficient high pressure, high velocity ammoniajet or an abrasive-ammoniajet mixture for initially cutting or penetrating the containment of a munition or ordnance, or any other target substrate having an interior compartment holding a hazardous substance or substrate contaminated with a toxic or hazardous material. In the process of cutting, a slurry or solution of hazardous substance(s) is formed therein for further treatment, i.e., demilitarization. this is achieved by treating the ammonia-containing slurry or solution with solvated electrons to degrade the hazardous material.

This embodiment of the invention is performed by the steps of:

(i) providing a system suitable for impinging a high pressure ammoniajet cutting fluid or abrasive-ammoniajet cutting fluid mixture from a cutting head onto a target substrate having an interior compartment at sufficient velocity to penetrate or cut the target substrate;

(ii) positioning in a work area the target substrate adjacent to the cutting head of the system;

(iii) shielding the target substrate and cutting head from the work area;

(iv) impinging the high pressure ammoniajet cutting fluid or abrasive-ammoniajet cutting fluid mixture to penetrate and/or cut the substrate for accessing the interior compartment;

(v) forming a slurry of the hazardous substance with the assistance of the high pressure ammoniajet cutting fluid or the abrasive-ammoniajet cutting fluid mixture entering the compartment after break through of the containment, and (vi) destroying the hazardous substance by forming a reaction mixture comprising the ammonia-containing slurry or solution of said hazardous substance and solvated electrons, and reacting the mixture.

Conveniently, the ammoniajet used during cutting phase (iv) for penetrating the outer containment or casing of the target substrate performs the further step of eroding, slurrying and/or dissolving the casing contents, and in one embodiment extracting or washing out hazardous substance (s) therefrom without a hiatus. This is achieved by the formation of a dispersion or slurry, and/or solution of the hazardous substance(s) from the ammonia delivered by the high pressure cutting jet, depending on the degree of solubility of the hazardous substance in anhydrous ammonia. Solvation of the hazardous substance occurs in-situ in the containment through turbulence generated by the high power jet of ammonia entering the containment after the initial breakthrough of the jet stream during the cutting phase, first by fracturing or eroding any composite materials therein into smaller particulates, or simply mixing/blending the hazardous material by churning the contents typically into a flowable slurry, dispersion, solution, and mixtures thereof. In one embodiment the flowable slurry/dispersion or solution exits the containment usually at the location where the cutting(s) occurred. Hence, the high pressure ammonia jet is not only a highly efficient means for cutting and accessing the interior of closed target substrates, but the energy of the cutting jet also performs as a pumping means in a highly efficient continuous sequence of steps whereby the ammoniajet stream utilized for initially cutting/penetrating the containment, also fractures, mixes and solubilizes the containerized contents, and pressurizes the mixture to thoroughly clean out the containment of all hazardous material. In so doing, all or virtually all hazardous material is recovered in a flowable dispersion, e.g., slurry, or solution which can be readily and safely transported to subsequent processing stations at reduced risk. This transportable slurry containing hazardous and toxic substances, e.g., energetic and/or chemical warfare agents, and so on can then be readily treated by reacting with solvated electrons, degrading or chemically destroying all such materials irrespective of their chemical composition.

BRIEF DESCRIPTION OF DRAWINGS

For a better understanding of the invention reference is now made to the drawings wherein.

DESCRIPTION OF THE PREFERRED EMBODIMENTS

Figure 1:
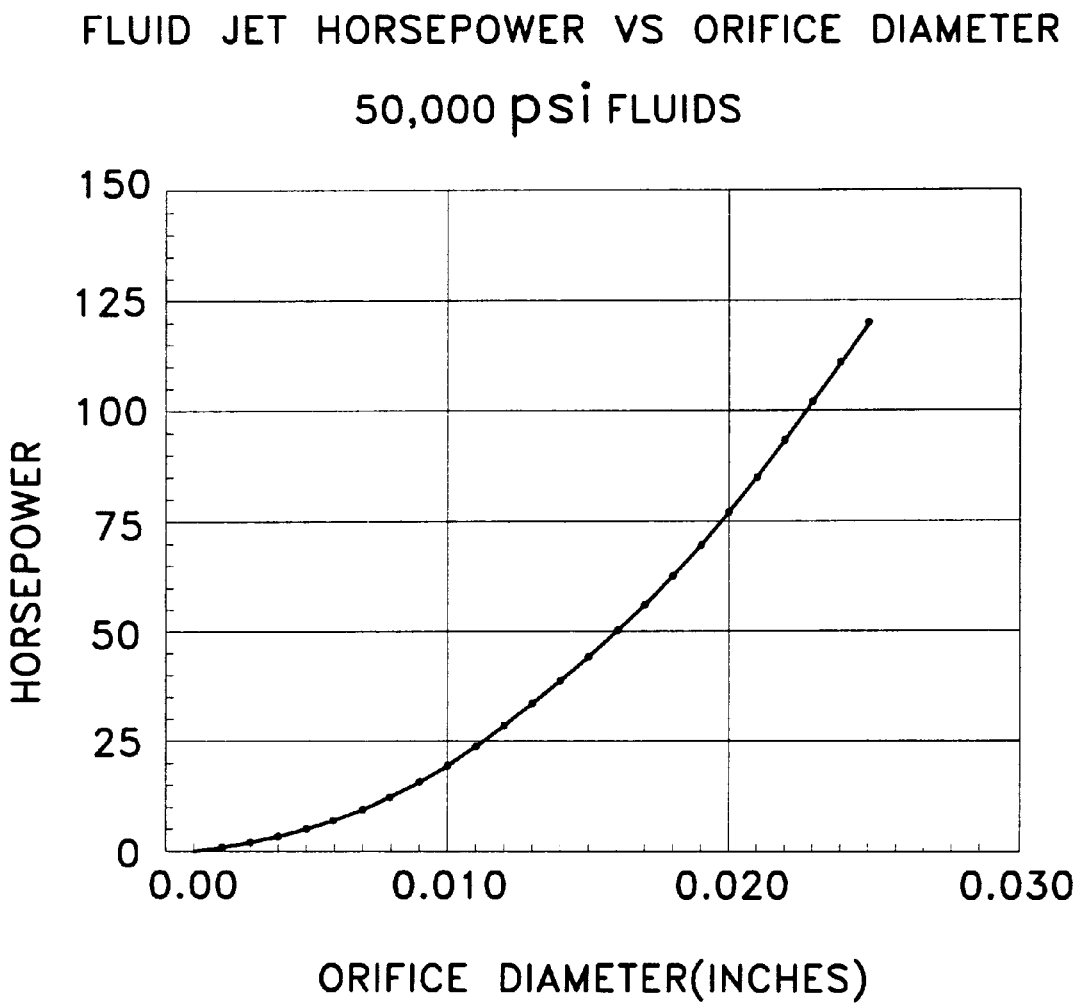
FIG. 1 is a graph representing the horsepower requirements of an ammoniajet pump relative to orifice size of a cutting head for the cutting system of this invention operating at a preferred pressure.

The invention encompasses at least two of the following three fundamental concepts:

(I) cutting structural shapes by impinging a high pressure jet of anhydrous liquid ammonia or anhydrous ammonia-abrasive mixture at high impact velocity at a closed containment or target substrate for faster, more efficient cutting rates i.e., up to 25 percent improvement over high pressure jet cutting methods conducted under equivalent conditions with water as the cutting fluid, and/or (II) Recovering a substance, substrate or article of manufacture from the interior of a target substrate by means of the high pressure ammoniajet or abrasive-ammoniajet as the slurrying fluid for the target substrate by utilizing the energy of the fluid jet for dispersing/dissolving and extracting the contents from the target substrate by power jet washing with the same high pressure ammonia jet as employed above (I). This concept is especially useful where the target substrate is a containment vessel, housing or casing for a chemical substance or article of manufacture, e.g., a munition, such as a high explosive projectile containing an energetic material where destroying, or alternatively recovering and salvaging the contents from its closed casing is economically desirable, but potentially hazardous. Penetrating and/or sectioning the target substrate with a power jet comprising anhydrous ammonia for accessing the contents of the casing and extracting and chemically modifying the energetic material and/or salvaging valuable substrates, such as rocket motors and other valuable hardware components which have become contaminated. This phase of the process can be performed not only at a faster, more efficient rate, relative to water as a cutting fluid, but also with greater safety because of reduced risk of explosion occurring when using anhydrous ammonia as the solvating fluid. Advantageously, (I) and (II) can be combined for more efficient cutting and washing so both utilize the energy from the ammonia power jet in a continuous, uninterrupted sequence of processing steps making it a more efficient, safer and economically attractive system for demilitarization, and the like.

(III) Further chemical demilitarization or detoxification is performed on the hazardous substance, e.g., chemical warfare agent ("CWA") or energetic material ("EM") recovered from a target substrate of (II) above as an ammonia-containing dispersion, particularly as a slurry or solution. The more safely transportable slurry of ammonia and hazardous substance can then be destroyed chemically. This is conveniently carried out by forming a reaction mixture with the slurry and/or solution of CWA and/or EM and ammonia, and by dissolving an active metal to form solvated electrons. This mixture is then reacted to destroy the EM, CWA or other hazardous material. The above slurry can be metered into a dedicated reactor comprising a preformed solution of solvated electrons, or the solution of solvated electrons metered into the ammoniated slurry or solution comprising the hazardous material. The invention also contemplates preparing solvated electrons in-situ wherein reactive metal, e.g., sodium, calcium, etc., dissolved in the ammoniated slurry or solution to destroy or degrade the hazardous material. Hence, ammonia performs multiple functions of cutting fluid, slurrying/dissolving and extracting fluid and solvent for a powerful dissolving metal reaction to produce a broad spectrum reducing agent, i.e., solvated electrons for reacting with and destruction of practically any unwanted chemical substance, particularly CWA's and EM's.

For purposes of this invention the expression "target substrate" as appearing in the specification and claims is intended as a shorthand expression for any opened, closed or unopened, insufficiently opened (for accessing interior contents), porous or leaking, non-disassembled, partially disassembled or disassembled containment structure, enclosure or vessel having a wall(s) defining one or more interior chambers or compartments therein, in combination with contents, potentially hazardous or otherwise, in the interior chamber or compartments. For example, a partially disassembled "target substrate" may comprise a warhead removed from a booster rocket. One wishing to demilitarize this partially disassembled munition may according to the above stated object gain access to the interior quickly and efficiently by impinging a high pressure ammoniajet to cut or penetrate the outer casing of the warhead for accessing a compartment in the interior holding a nerve agent or other hazardous substance, such as an energetic material. One may also wish to gain access to the interior of a rocket for purposes of recovering a component therein for reuse, such as a rocket motor which is not per se hazardous or toxic. Similarly, this initial step of cutting or penetrating the casing of a target substrate may be required either because a manufactured opening or access port is insufficient for performing a particular task, or possibly due to the absence of any port or opening allowing access to the interior contents.

The above containments, enclosures or vessels are intended to include a broad range of structures, and include, but are not limited to such categories generally recognized as housings, receptacles, cases or casings or encasements, shells, magazines, cartridges, canisters, cans, drums, barrels, pails, bottles, and so on. Typically, these containments, enclosures or vessels are fabricated from a broad range of materials which are generally solid, rigid or semi-rigid, and are comprised of a metal or metal alloys, such as aluminum and steel; polymers and plastics, including reinforced plastics and composite structures comprising, for instance, reinforcements like fibers, filaments or whiskers of glass, metal; thermosetting or thermoplastic resins and plastics. Other materials of construction for containments, enclosures and vessels can include concrete, glass, wood or so called man-made compositions, composite materials, and so on.

"Target substrate" includes more than containments, but also comprise specific articles of manufacture and devices, such as munitions and ordnance (e.g.,rockets, land mines, mortar and artillery shells, cartridges, and missiles, and other projectiles which may comprise chemical warfare agents and/or energetic materials, chemical propellant, and so on). Further representative examples would include canisters or other container formats holding energetics, chemical warfare agents, and other miscellaneous ordnance. Also included are closed containment vessels, such as plastic or steel drums filled with military waste and hazardous by-products from manufacturing processes, as well as substrates, such as contaminated or used oils, dielectric fluids, hydraulic fluids, solvents, inert adsorbent materials, e.g., wood chips and other miscellaneous cellulosic materials, including ground corn cobs, saw dust. Solid substrates may have sorbed (adsorbed or absorbed) thereon hazardous chemicals, or other potentially toxic substances, such as radionuclides and other nuclear waste materials and by-products, dangerous heavy metals, hazardous organics, such as PCBs, as well as dioxins, various pesticides, to name but a few. Hazardous radioactive and non-radioactive metals include such representative examples as selenium, cobalt, mercury, cadmium, chromium (VI), lead, uranium, plutonium, thorium, and so on. Liquids, such as oils and solvents may also be contaminated with the foregoing hazardous/toxic substances.

"Target substrates" are also intended to include containments holding equipment, tools and textiles, such as articles of protective clothing, including gloves, shoes, and the like, which have been exposed to toxic substances, but must be decontaminated as part of a disposal or recycling process.

Importantly, the expression "target substrate" is not limited to munitions, and other manufactured articles and materials, but also contemplates bulk containerized hazardous substances used by industry or the military, e.g., including hazardous chemicals, chemical warfare agents and energetics.

"Energetic materials" or "EM" for purposes of this invention are intended to relate to substances in three classes of products, namely, explosives, propellants, and pyrotechnics; see, for example, Department of the Army Technical Manual TM 9-1300-214, *"Military Explosives,"* Headquarters, Dept. of the Army, 1984 and the manual provided at *"An Introduction to Explosives,"* presented at the FAA's Energetic Materials Workshop, Avalon, N.J., Apr. 14–17, 1992. The EM's in explosives and propellants, when chemical reaction is properly initiated, generate large volumes of hot gases in a short time, the primary difference between propellants and explosives being the rate at which the reaction proceeds. In explosives, a fast reaction produces a very high pressure shock wave which is capable of shattering objects. In propellants, a slower reaction produces lower pressure over a longer period of time. Pyrotechnics evolve large amounts of heat, but much less gas than explosives and propellants.

Explosive and especially propellant compositions, which this invention is intended to include, can comprise complex mixtures of various inorganic and organic chemical compounds, as well as discrete, physically separate components in an explosive or propellant train. Various additives may be incorporated into the composition along with the EM's, for example, to control shock-sensitivity or, especially in the case of propellants, to maintain the flame temperature within a certain range and to achieve the maximum energy output given that temperature limitation.

More specifically, EMs for purposes of this invention include, materials from the classes of primary explosives, boosters and secondary explosives. Primary explosives are highly sensitive and are used as initiators to trigger the redox train of events leading to detonation. Booster charges are less sensitive and are employed in larger quantity to carry on the redox initiation and cause detonation of the secondary explosive, which is the main or bursting charge. The latter charge is the least sensitive material in the train. The EM's used in primary explosives tend to be somewhat different chemically than the booster and secondary explosives, but the booster and secondary explosives are conveniently treated together, since the same EM's can be employed in both.

The EM's in primary explosives include, but are not limited to lead azide, $Pb(N_3)_2$; mercury fulminate, $Hg(ONC)_2$;4,5-dinitrobenzene-2-diazo-1-oxide,"DDNP"; lead styphnate, which is a lead salt of 1,3-dihydroxy-2,4,6-trinitrobenzene; tetracene, also known as guanyldiazoguanyltetracene or 4-guanyl-1-(nitosoaminoguanyl)-1-tetracene; potassium dinitrobenzofuroxane, "KDNBF"; lead mononitroresorcinate, "LMNR"; and combinations thereof. These EM's all include either metal in a positive valence state, or at least one nitro or diazo group.

The EM's in booster and secondary explosives include several classes, i.e., aliphatic nitrate esters, nitramines, nitroaromatics, ammonium nitrate, and mixtures of the immediately preceding. Industrial explosives may contain at least some of the same EM's used in weapons, as well as some other closely related compounds of similar structure.

Aliphatic nitrate ester EM's are characterized by containing C—O—$NO_2$ groups and include, but are not necessarily limited to, for example, 1,2,4-butanetriol trinitrate, "BTTN"; diethyleneglycol dinitrate, "DEGN"; nitrocellulose, "NC," of which there are several types depending upon the nitrogen content; nitroglycerin, "NG" or glycerol trinitrate; nitrostarch, "NS," which is similar to nitrocellulose; pentaerythritol tetranitrate, "PETN"; triethyleneglycol dinitrate, "TEGN" or "TEGDN"; and 1,1,1-trimethylolethane trinitrate, "TMETN" or "MTN."

Nitramine EM's are characterized by containing N—$NO_2$ or $N^+$—$NO_3^-$ groups and include, but are not necessarily limited to, for example, cyclotetramethylenetetranitramine, "HMX"; cyclotrimethylenetrinitramine, "RDX"; ethylenediamine dinitrate, "EDDN"; ethylenedinitramine, "Haleite"; nitroguanine, "NQ"; and 2,4,6-trinitrophenylmethylnitramine, "Tetryl", which could also be classified as a nitroaromatic; see below.

Nitroaromatic EM's are characterized by containing one or more C—$NO_2$ structural units and include, but are not necessarily limited to, for example, ammonium picrate, "Dunnite" or ammonium 2,4,6,-trinitrophenolate; 1,3-diamino-2,4,6-trinitrobenzene, "DATB"; 2,2',4,4',6,6'-hexanitroazobenzene, "HNAB"; hexanitrostilbene, "HNS"; 1,3,5,-triamino-2,4,6-trinitrobenzene, "TATB"; and 2,4,6-trinitrotoluene, "TNT."

Ammonium nitrate, $NH_4NO_3$, is in a class by itself and is the least sensitive of the military explosives. A number of other named explosives are obtained by mixing various EM's, and a myriad of combinations are possible, only a representative number of which are described here; others are described in various literature citations. Some of these include binary mixtures, for example, the "Amatols," which are mixtures of ammonium nitrate and TNT; "Composition A," a mixture of RDX and a desensitizer such as wax; "Composition B," "cyclotols," which are RDX plus TNT; "Composition C," RDX plus plasticizer; "Ednatols," Haleite and TNT; "Octols," mixtures of HMX and TNT; and "Pentolite," which is PETN/TNT; and so forth.

Ternary mixtures include "Amatex 20, which contains RDX, TNT, and ammonium nitrate; and the "Ammonals," which are mixtures of ammonium nitrate and aluminum, together with high explosives, such as TNT, DNT and RDX. Other named mixtures include "HBX," "H-6," "HTA," "Minol-2," "Torpex," and so forth. A quaternary explosive is exemplified by "BBX" which includes TNT, RDX, ammonium nitrate and aluminum metal. Other mixtures include the plastic-bonded explosives or "PBX" explosives which contain one or more high explosives, for example, RDX, HMX, HNS, and/or PETN in admixture with a polymeric binder, rubber, plasticizer, and a fuel, such as powdered aluminum or iron.

Explosives classed as industrial explosives includes dynamite, which comprises mixtures of nitroglycerin and clay, such as Kieselguhr. Another widely used industrial explosive is the combination of ammonium nitrate and fuel oil, "ANFO." Water gel and slurry explosives are also used industrially and can include ammonium nitrate, Pentolite, TNT, etc. as the EM's.

The EM's contained in propellants are some of the same EM's employed in explosives and described herein. The principle EM's used in propellants include nitrocellulose, nitroglycerine and nitroguanidine. Other components typically are present to control the flame temperature, maximize energy content at that temperature, reduce the tendency of a gun to exhibit secondary flash, minimize barrel erosion, provide useful physical properties to the propellant, and control cost. The following components, along with general ranges in the amounts of several of them, can be found in typical propellants, although not all of these ingredients are necessarily present in a single propellant.

TABLE 1

Typical Components of propellant Compositions

| Component | Range (Wt. %) |
|---|---|
| Nitrocellulose (~13% N) | 20–100 |
| Nitroglycerin | 10–43 |
| Nitroguanidine | 48–55 |
| Barium nitrate | 1.4 |
| Potassium nitrate | .75–1.25 |
| Lead carbonate | |
| Lead stearate | |
| Dinitrotoluene | 8–10 |
| Dibutylphthalate | 3–9 |
| Diethylphthalate | 3 |
| Dimethylphthalate | |
| Diphenylamine | .7–1 |
| Nitrodiphenylamine | |
| Ethyl centralite | .6–1.5 |
| Graphite | .1–.3 |
| Cryolite | .3 |
| Triacetin | |

The non-EM components of typical propellants do not appreciably affect the methods of this invention.

Chemical warfare agents (sometimes abbreviated "CWA") as appearing in the specification and claims is intended to include a very broad range of substances from poison gases, incendiary materials, and biological microorganisms employed to disable personnel, as well as pesticides, herbicides, and similar substances which can be employed to interfere with the growth of plants, insects, and other non-mammalian species. CWA is intended to also include agents which are effective in relatively small dosages to substantially disable or kill mammals within a relatively short time period. They may also include agricultural chemicals used primarily to control plants, Hexapoda, Arachnida, and certain fungi. Furthermore, for purposes of this invention, the expression "chemical warfare agent" also is intended to include those replicating microorganisms commonly known as biological warfare agents, including viruses, such as equine encephalomyelitis; bacteria, such as those which cause plague, anthrax and tularemia; and fungi, such as coccidioidomycosis; as well as toxic products expressed by such microorganisms; for example, the botulism toxin expressed by the common *Clostridium botulinum* bacterium. Also included in the expression "chemical warfare agent," as it is used herein, are those naturally occurring poisons, such as capisin (an extract of cayenne pepper and paprika), ricin (a toxic substance found in the castor bean), saxitoxin (a toxic substance secreted by certain shellfish), cyanide salts, strychnine (a plant-derived alkaloid), and the like.

Above all, it is to be understood, the expression "chemical warfare agent" encompasses a series of "poison gases" which appeared on battlefields in the World War I era. These substances are primarily gases near room temperature and include cyanogen chloride, hydrogen cyanide, phosgene and chlorine. CWA is also intended to encompass those primarily liquid substances, including vesicants which were first used in World War I, and refinements, such as the nerve agents which have appeared on the scene more recently. CWA includes substantially pure chemical compounds, but also contemplates mixtures of the aforesaid agents in any proportions, as well as those agents in impure states in which the other components in the mixture are not simply other CWA's. "Chemical warfare agents," as used herein, also includes partially or completely degraded CWA's, e.g., the gelled, polymerized, or otherwise partially or totally decomposed chemical warfare agents commonly found to be present in old munitions.

As pointed out above, this invention is applicable to the treatment of weapons containing a wide range of CWA's. The method is especially effective when the CWA is selected from the group consisting of vesicants, nerve agents, and mixtures thereof, the formula of the vesicants contains at least one group of the formula:

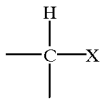

(I)

in which X is halogen.

The nerve agents are represented by the formula:

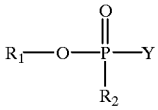

(II)

in which $R_1$ is alkyl, $R_2$ is selected from alkyl and amino, and Y is a leaving group.

In the vesicants it is preferred that X in the aforesaid formula (I) be selected from fluorine, chlorine and bromine. In the vesicants most commonly found around the world, X is chlorine, and it is especially preferred that X in formula (I) be chlorine for that reason. Two of the most widely available, and thus important vesicants to which the processes of this invention are applicable are mustard gas, also called "HD," or 1,1'-thiobis[2-chloroethane), or di(2-chloroethyl)sulfide and "Lewisite" or dichloro(2-chlorovinyl)arsine.

Both of these chemical warfare agents were employed in World War I. Munitions constructed in that era, about 75 years ago, containing these CWA's are still to be found in the field, old warehouses, and so forth. At least in the case of some of the munitions containing HD mustard, some, most, or all of the HD has deteriorated into a gel or crusty polymerized material of undefined structure and composition. It has been found, quite unexpectedly, that the demilitarization processes of this invention are effective in munitions not only containing HD, but also the gelled and crusty products of HD degradation, termed "HD heel."

In the nerve agents of formula (II) to which the process of this invention can be applied, Y is a leaving group; that is, Y is an atomic grouping which is energetically stable as an anion, the more preferred leaving groups being those which are most readily displaced from carbon in nucleophilic substitutions and, as anions, have the greatest stability. Although a host of such leaving groups are well known, it is preferred that the leaving group Y be selected from halogen, nitrile (—CN), and sulfide (—S—), since these are the groups Y, present in the nerve agents distributed most widely throughout the world. Among the halogens, it is most preferred that Y be fluorine, chlorine or bromine, fluorine being especially ubiquitous in the most readily available nerve agents.

$R_1$ in formula (II) can be alkyl, preferably lower alkyl, i.e., $C_1$–$C_6$, straight chain or branched or cyclic, e.g., methyl, ethyl, propyl, iso-propyl, iso-butyl, tert-butyl, cyclohexyl, or trimethylpropyl. $R_1$ in the most widely distributed nerve agents is methyl, ethyl or 1,2,2-trimethylpropyl and so these alkyl groups are preferred for that reason.

$R_2$ in formula (II) can be alkyl or amino. In the case that $R_2$ is alkyl, it is preferred that alkyl be as defined above for $R_1$, alkyl $R_2$ in the most widely distributed nerve agents being methyl, the most preferred alkyl $R_2$ being methyl for that reason. In the case that $R_2$ is amino, $R_2$ can be primary, secondary or tertiary alkylamino, or dialkylamino, or trialkylamino, alkyl being as defined above for $R_1$, dialkylamino being preferred, with dimethylamino being especially preferred for the reason that $R_2$ is dimethylamino in the most widely distributed nerve agent in which $R_2$ is amino.

Specific representative nerve agents which are widely distributed around the world, and hence are among the most important nerve agents to which the processes of this invention can be applied, are: "Tabun," or "GA," or dimethylphosphoramidocyanidic acid, or ethyl N,N-dimethyl phosphoroamidocyanidate; "Sarin," or "GB," or methylphosphono-fluoridic acid 1-methyl ethyl ester, or isopropyl methyl phosphonofluoridate; "Soman," or "GD," or methylphosphono-fluoric acid 1,2,2-trimethylpropyl ester, or pinacolyl methyl phosphonofluoridate; and "VX," or methylphosphonothioic acid S-[2-[bis(1-methyl ethyl) amino]ethyl] ethyl ester, or ethyl S-2-diisopropyl aminoethyl methylphosphorothioate.

In January 1993, representatives from more than 130 nations signed the final draft of the Chemical Weapons Convention, which outlaws the production, use, sale, and stockpiling of all chemical weapons and their means of delivery, calling for the destruction of existing stocks by the year 2005. About sixty of the signatory nations have ratified the treaty. In 1993, some 20 nations were suspected of possessing chemical arsenals or having the means to make them.

An estimated 25,000 tons of CWA's in the United States and 50,000 tons of CWA's in the former Soviet Union, contained in bulk storage vessels, metal barrels, canisters, rockets, land mines, mortar and artillery shells, cartridges, and missiles, must be destroyed if the 1993 Convention is to be carried out. The costs for carrying out demilitarization have been estimated at US$ 8 billion and US$ 10 billion, respectively, for the United States and the former Soviet Union alone. The methods of this invention are intended for use in demilitarizing CWA in all formats, including those contained by such "target substrates" as bulk storage vessels, metal barrels, canisters, rockets, land mines, mortar, artillery shells, cartridges, missiles, and so on.

The invention disclosed and claimed herein also addresses the problem of providing a method for demilitarization of the energetic materials incorporated into the explosives and/or propellants used as delivery means for the CWAs. It was found that the methods disclosed can be used to access, remove and destroy CWA's can also be employed to access and destroy the EM's contained in the delivery means which accompany the CWA's. This greatly simplifies the demilitarization of the complete package of hazardous substances accompanying and including the CWA's, but also provides an attractive method for demilitarizing EM's outside the CWA context as well. This would include, for example, the access, removal and chemical destruction of unwanted reserves of containerized chemical warfare agents alone, or which might also contain energetic materials. An example of this combination would be the U.S. Army's M55 rocket, a chemical warfare weapon. The "M28" propellant in the M55 rocket is known to comprise a mixture of nitrocellulose, trinitroglycerin, binders and stabilizers. The burster charge, which disperses the nerve agent upon rocket impact is an explosive mixture comprising trinitrotoluene (TNT) and cyclomethylenetrinitramine (RDX), or otherwise known as "Composition B." Accordingly, the invention herein described also includes the demilitarization of such weapons wherein it is desirable to access the interior and remove the hazardous contents.

This includes the step of accessing the interior of a closed encasement or insufficiently opened or partially disassembled holding the hazardous chemical substances by efficiently sectioning the casing by means of the high pressure ammoniajet or abrasive ammoniajet as a preliminary step in accordance with the methods described in detail herein. This preliminary step is then followed by employing the same high pressure jet stream for dissolving or dispersing the hazardous materials in the opened casing. The dispersed hazardous material, including EM's and CWA's can then be readily destroyed by reacting with ammoniated/solvated electrons.

The ammonia jet cutting system used in practicing this invention may be comprised of any standard 50 hp, 40,000 psi (nominal) commercial waterjet system capable of delivering about 4.0 liters/minute of anhydrous ammonia at rated pressures. However, because ammonia will attack copper, brass and zinc components all metal alloys comprising such metals should be removed from the system, and replaced with stainless steel components. In addition, the elastomeric seals and gasketing materials of the system pumps should be replaced with neoprene or other anhydrous ammonia resistant materials. In the United States, the major producers of high pressure water and abrasive jet cutting systems are Flow International, Inc., Kent, Wash.; Ingersoll-Rand Corp., Farmington Hills, Mich. and Jet-Edge, Inc., Golden Valley, Minn. Any of their high pressure water and abrasive jet cutting systems are suitable for modification in accordance with above guidelines. For example, the O-rings in the piston seals should be replaced with neoprene O-rings, and the bronze bushings and guides replaced with ASI 304 stainless steel in the Cougar™ or 25X™ water intensifiers from Flow International, Inc. When plumbing the system, only high quality tubing and valves should be used, such as those available from Harwood Engineering, Walpole, Mass.; High Pressure Equipment of Erie, Pa. and Autoclave Engineers of Erie, Pa. The tubing should be autofrettaged to about three times the working pressure for safety and hydrostated. The rating on the tubing and valves should exceed the maximum pressure that the pumps can achieve irrespective of no plans to operate them at maximum pressure. Typical ratings for such valves and tubing are 30,000 psi, 60,000 psi or 100,000 psi. The system should be equipped with an approved safety relief valve or burst diaphragm to protect the system in the event of an accidental overpressure.

Anhydrous liquid ammonia can be used alone as the cutting fluid, i.e., "ammoniajet." Alternatively, anhydrous liquid ammonia-abrasive composition, i.e., "abrasive ammoniajet" can be used as a mixture wherein the ammonia is the carrier for an abrasive. "Anhydrous ammonia" or "anhydrous liquid ammonia" as used herein is intended to have its ordinary understood meaning, $NH_3$, preferably not less than a commercial grade material comprising at least about 99.5 percent ammonia. Refrigerant grade material comprising at least about 99.7 percent ammonia is most preferred. It will be understood, however, that some deviations from commercial and refrigerant grade anhydrous ammonia are permissible in accordance with practices of this invention, especially with recycled ammonia from the ammonia recovery system which may contain modestly higher levels of moisture from prior usage. In each instance, however, the anhydrous liquid ammonia should be as clean and uncontaminated as possible. Preferably, fluids should be filtered down to 5 microns by either reverse osmosis or mechanical filters, of conventional design. Newly installed systems should run their pumps for several hours with the fluid jet orifices removed to flush out any debris which may have entered the tubing or system during assembly.

The orifice of the cutting head is also an important component of the fluid cutting system. The useful orifices are adapted from precision watch jewels and are typically manufactured from synthetic sapphire, synthetic ruby or diamond. Jeweled orifices are available in sizes ranging from 0.001 inches up to about 0.050 inches. The size of the jewel is dependent on the horsepower of the pump and the pressure the system can operate at. FIG. 1 illustrates the horsepower requirements for the ammonia jet cutting system operating at the approximate pressure of 50 kpsi, a preferred operating range for this invention. As a general rule of thumb, to maintain a 50,000 psi pressure at the orifice of the cutting head, 250,000 hp/in$^2$ of orifice area is needed. It will be observe that a 25 hp pump can run one 0.011 inch or smaller orifice at 50,000 psi. The area of a 0.011 inch orifice is about 0.00009 in$^2$. With a 50 hp pump, one cannot double the diameter of the orifice and maintain pressure. One can only double the area of the orifice. This would result in a 0.016 in. orifice. For purposes of this invention, one would not go above about 50 hp/orifice since the orifices are not that strong as to be able to withstand very high flow rates without excessive erosion or chipping of the orifice. Optimally, more effective cutting can be performed by using multiple orifices, and taking several cuts rather than having one larger orifice doing all the cutting. The general formula for calculating orifice size is:

$$m=\rho^*A_o^*V_{jet}$$

wherein m is mass flow rate; ρ is fluid density; $A_o$ is the orifice area and $V_{jet}$ cutting jet velocity in meters/seconds.

The fluid jet machining system employed in the cutting and washing steps of the methods of the invention discharges at high pressure anhydrous ammonia, as previously discussed. As it passes through the orifice the pressure of the fluid is transformed into velocity. Since the mass of the fluid is constant, the velocity increases the fluid jet's kinetic energy dramatically according to the equation $$K_e=\tfrac{1}{2}\, m^*v^2$$

where $k_e$ is kinetic energy; m is the fluid mass and v is fluid velocity. In the case of an ammoniajet, the kinetic energy is utilized to directly erode the target substrate, or in the case of abrasive-ammoniajet accelerate the particles of abrasive to abrade and erode the target. Thus, the velocity the fluid jet can reach is based on the formula:

$$V_{jet}\cong\sqrt{2p/\rho}$$

where $V_{jet}$=jet velocity in meters/second; p is fluid pressure in kilopascals and ρ is fluid density in gm/cm$^3$.

A major advantage of the invention is based on this inventor's discovery that anhydrous ammonia enables one to achieve up to a 25 percent improvement in cutting efficiency over water used under the same operating conditions. This means higher cutting speeds for minimizing cost per unit treated, which translates to significantly improved economics. To achieve this objective, concentrating the highest amount of kinetic energy on the work piece at the highest fluid pressure possible is necessary. While not wishing to be held to any specific mechanism for achieving this substantial improvement in cutting efficiency, it is nevertheless thought to be due to the density of ammonia which is about 25% less than water at the operating conditions of this invention. As pointed out above, the velocity of a cutting jet according to the equation ($V_{jet}$), is directly influenced by fluid density. Advantageously, with anhydrous liquid ammonia this enables forming a cutting jet which is approximately 25% faster than that of water. Hence, the particles of the cutting jet of this invention are thought to possess increased kinetic energy and enhanced cutting ability over water because they are accelerated at significantly greater velocities.

As previously stated, the pressure of the cutting fluid is an important parameter because pressure has a direct relationship to fluid velocity and for every target material there is a minimum impact velocity required to cut the material in a reasonable time interval. Generally, the fluid jet pressure, i.e., pump pressure of the fluid jet upstream to the orifice of the cutting head should be sufficiently greater than the yield strength of the target substrate being cut in order to complete the cutting process within a shortest time interval, but preferably not in excess of those operating pressures which otherwise are likely to substantially increase the potential for fluid jet cutting equipment failure or substantially shorten equipment life expectancy. The pressures employed are greater than those utilized by Melvin et al (I) and (II) which are intended for eroding, or alternatively, fracturing solid chemical propellants in rocket motor casings for removal and recovery. Melvin et al (I) and (II) are concerned with treating frangible materials which are subject to erosion or which can be fractured into smaller particles. Accordingly, the present invention utilizes pressures which are sufficient to penetrate and/or cut solid containments, such as steel containments or casings for accessing interior chamber(s) or compartment(s), such as rocket motor casings, or other containments as previously discussed.

More specifically, the anhydrous ammonia of the ammoniajet (without abrasive) can be in the range from about 30,000 psi to as high as 150,000 psi, but more preferably, from about 40,000 to below about 100,000 psi. However, with most state of the art commercially available waterjet cutting machines, when operating at pressures above 60,000 psi for cutting materials having yield strengths of at least 20,000 psi, it is preferred that an abrasive ammonia jet cutting fluid mixture be used rather than ammonia without abrasive. Operating pressures in excess of 60,000 psi can cause premature wear on pump systems and other components of fluid jet cutting devices, which in turn can lower reliability factors, cause premature equipment failure, and result in costly down time. In such instances, it has been found that abrasive ammoniajet cutting is preferred over an ammoniajet. Abrasive ammoniajet cutting fluid allows lower operating pressures than ammonia alone. Generally, abrasive ammoniajet cutting can be performed at operating pressures in a range of between about 20,000 and 75,000 psi, and efficiently cut metals having high yield strengths. More preferably, abrasive ammoniajet cutting is performed in the range of between about 20,000 and about 60,000 psi for most metallic targets. Thus, when fluid jet cutting, for example, an aluminum target having a yield strength of 20,000 psi, it is more efficient to employ an abrasive ammoniajet in place of anhydrous ammonia alone. Otherwise, to cut aluminum efficiently with anhydrous ammonia alone the minimum recommended pressure for high efficiency cutting is 60,000 psi. However, with abrasive ammoniajet the operating pressure can be reduced to as low as 20,000 psi and still achieve an efficient cutting rate. This concept can be aptly demonstrated from the following table which illustrates substrates with various yield strengths, and cutting fluid pressure options for efficient cutting rates:

ABRASIVE AMMONIA JET APPLICATION

| Material | Yield Strength (psi) | Ammonia Jet Min. Pressure | Ammonia Jet Opt. Pressure | Abrasive Ammonia Jet Min. Pressure | Abrasive Ammonia Jet Opt. Pressure |
|---|---|---|---|---|---|
| Lead | 500 | 1500 | 20–75 ksi | 1 ksi | 20–75 ksi |
| Tin | 1000 | 3000 | 20–75 ksi | 1 ksi | 20–75 ksi |
| Plastic | 1000 | 3000 | 20–75 ksi | 1 ksi | 20–75 ksi |
| Zinc | 1500 | 4500 | 20–75 ksi | 1 ksi | 20–75 ksi |
| Aluminum | 20000 | 60000 | 75–150 ksi | 1 ksi | 20–75 ksi |
| Magnesium | 25000 | 75000 | 100–150 ksi | 1 ksi | 20–75 ksi |
| Monel | 40000 | 120000 | 150+ ksi | 1 ksi | 20–75 ksi |
| Nickel | 50000 | 150000 | 150+ ksi | 1 ksi | 20–75 ksi |
| Steel, Stainless | 65000 | | | 1 ksi | 20–75 ksi |
| Steel, alloy | 100000 | | | 1 ksi | 20–75 ksi |
| TNT | | | 20–75 ksi | | |
| RDX | | | 20–75 ksi | | |
| Tetryl | | | 20–75 ksi | | |
| HMX | | | 20–75 ksi | | |
| Glass | | | | 1 ksi | 20–75 ksi |
| Wood | | 12000 | 20–75 ksi | 1 ksi | 20–75 ksi |

Based on the above table it is apparent the ammoniajet is capable of directly cutting many low yield-strength materials without the use of abrasives. To assure efficient cutting rates of harder materials having higher yield strengths abrasive ammoniajet cutting is usually preferred. Generally, the abrasive ammoniajet comprises a mixture of abrasives commonly employed in high pressure waterjet cutting, but dispersed in the anhydrous liquid ammonia.

Practically any abrasive can be used which is soft enough to minimize wear on components, sufficiently friable to readily form new cutting edges, economical in cost, and graded with sufficient accuracy to prevent plugging the fluid jet cutting system with particles which are either too large or small. Typically, the coarser the abrasive, the faster and more aggressive the cutting action. For most cutting applications with a surface finish of about 125 micro inches, an 80 mesh abrasive may be used. For finer finishes, an abrasive down to 1000 mesh can be employed. A preferred range of abrasive sizes for most ammoniajet cutting applications is generally from about 80 mesh to about 150 mesh. Larger mesh abrasives may be used, but in some instances the focusing tube may become plugged with such larger size particles.

The mass of abrasive used in ammoniajet cutting has a nonlinear effect on cutting speed of the jet. Too little of the abrasive material in the ammoniajet prevents the jet from making adequate cutting grains on the target surface. Too much abrasive causes the mixing tube to become overloaded whereby cutting efficiency falls off rapidly. As a general rule, abrasive mass flow rate used is 85 percent of the maximum cutting quantity. More specifically, the abrasive is used at the rate of about one pound per gallon of liquid ammonia typically at a pressure of 50,000 psi. This provides a highly efficient cutting rate for most metallic substrates. This is about a 13 percent on a mass ratio to the ammonia to provide economical operation. Maximum cutting rates can be achieved with additional abrasive in the 17 to 20 percent range. With more than 20 percent on mass ratio to ammonia, cutting efficiency diminishes rapidly as the system becomes clogged on the excess abrasive material in the focusing tube.

Almondine garnet having a Knoop hardness of 1350 is the abrasive of choice for many abrasive ammoniajet cutting operations. It has been found that garnet abrasive of 100 mesh particle size is efficient and economical for cutting various metals, such as titanium, steel and aluminum. As a general rule, the abrasive grains should be harder than the target materials. Materials like steel shot, for example, may be used to cut steel, but at a speed penalty. Steel shot can still be used efficiently to cut steel if the shot is hardened by quenching from a high heat (known as chilled shot), and is capable of performing just as a hardened steel file can cut most steels. Glass and silica (silicon dioxide or quartz) are substantially harder than steels, so they can be readily used to cut steels or materials that are softer than steels, e.g., brasses, bronzes, copper, aluminum, nickel, lithium, sodium, potassium, calcium, magnesium, wrought iron, cast iron, uranium, graphite, composites, plastics, marble, limestone, common ceramics, zirconium, and so on. Glass can be cut with silica abrasive, but not with softer abrasives. With softer abrasives there are corresponding slower cutting speeds compared to garnet; higher material costs and potential health consequences. Silica, for example, is low in cost, but is a U.S. Government regulated material (OSHA: Occupational Safety and Health Administration) because of its potential for causing silicosis among workers exposed to fine silica dusts. On the other hand, steel shot, is safe to use, but is substantially more costly than garnet, and has a slower cutting speed.

Abrasive ammoniajet cutting procedures according to this invention may employ either of two delivery methods commonly used in the high pressure abrasive jet cutting art: (i) cutting wherein the anhydrous ammonia passing through the cutting head entrains abrasive particles by aspiration and mixes them by mechanical action into a high-velocity stream of anhydrous ammonia inside a focusing tube for discharge onto the work piece. Alternatively, (ii) a mixture of anhydrous ammonia and abrasive particulates is premixed into a slurry which is then pressurized and forced through a discharge nozzle onto the work piece. While slurry jets (ii) are potentially more efficient than entrained abrasive cutting (i) current abrasive jet cutting equipment has been found not fully capable of operating at pressure levels as high as those operating with entrained abrasive. Consequently, ammonia-jet cutting with entrained abrasives provides greater scope in operating versatility, and therefore, is somewhat more preferred.

This invention contemplates applications where the downstream presence of abrasives may be detrimental. Under such circumstances, separation means including filtration methods, or alternative abrasives, e.g., chilled steel or ferromagnetic abrasives are employed to enable magnetic separation from the liquid.

Figure 2:
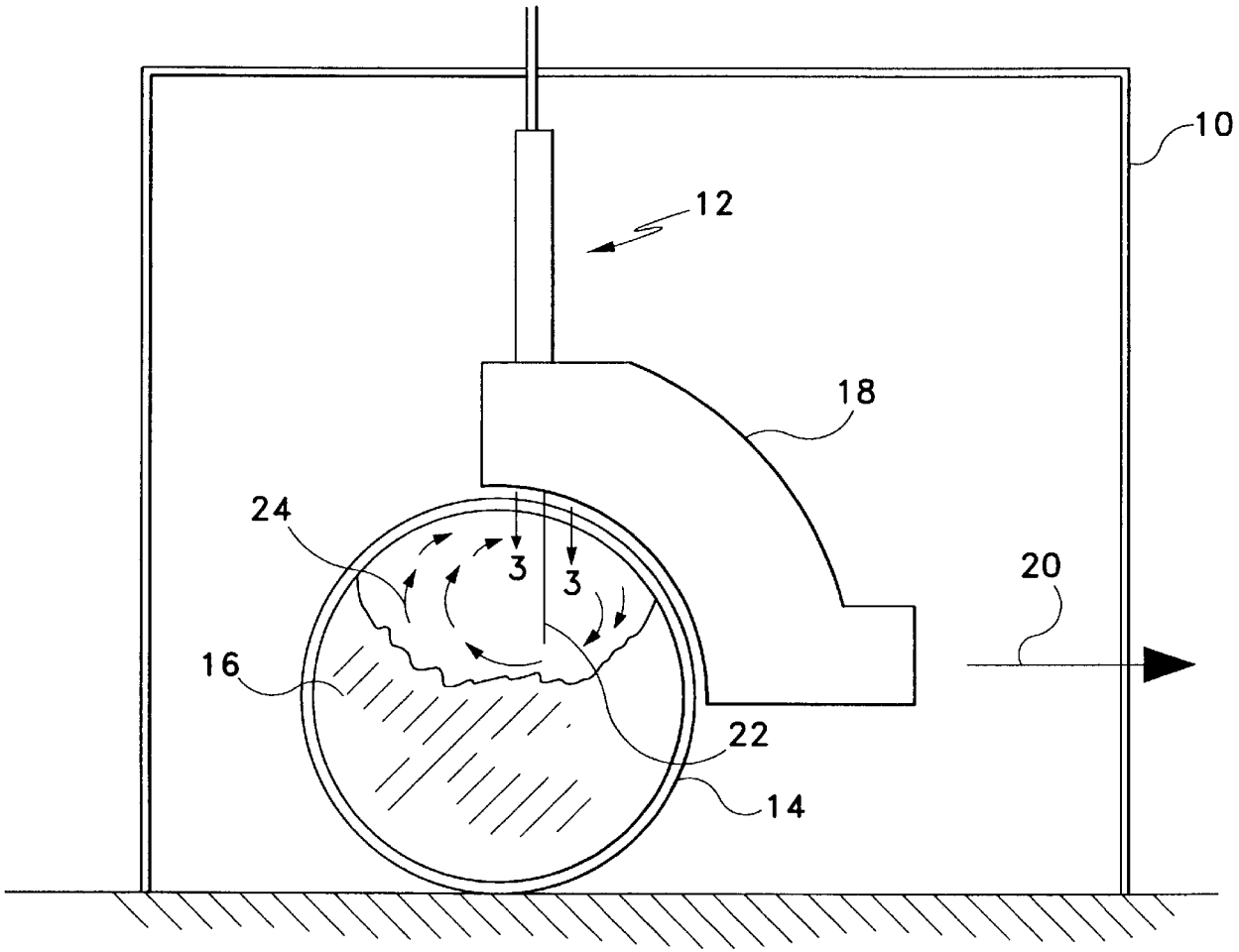
FIG. 2 is a sectional diagrammatic view illustrating the positioning of a fluid jet cutting head and ammonia jet stream relative to a closed military projectile in demilitarization thereof for optimizing use of the energy of the jet stream for both penetrating the casing, dispersing energetic material, and for removal of the contents for further treatment.

Methods of the invention and how they may be practiced can be best demonstrated by reference to the drawings beginning with FIG. 2 which illustrates a closed protective chamber 10 which is a sealed enclosure either a protective hood or other suitable housing for ammoniajet cutting assembly 12 and work piece 14. In this instance, work piece 14 may be a closed high explosive projectile, e.g., M55 rocket consisting of aluminum and steel casing sections with wall thicknesses varying from 0.125 to 0.375 inches, containing an energetic material 16, the objective being demilitarization of the projectile by accessing the interior of the closed steel casing for extraction and recycling energetic material 16. Protective chamber 10 should be capable of safely operating at a minimum of 250 psig, and be constructed to ASME pressure vessel codes (Section VIII Boiler and Pressure Vessel Standards by the American Society of Mechanical Engineers, NY, N.Y.). Chamber 10 should be fitted with pressure release safety valves (not shown) capable of protecting the chamber in the event of a pressure excursion. The closed explosive projectile 14 can be secured in chamber 10, for example, by fitting with a drive collar (not shown) to the aft end of the rocket and the unit loaded tail end first into the chamber. Advantageously, projectile 14 is secured to motorized rotating chuck (not shown) of conventional design for rotation during cutting and washout phases. Once the projectile is mounted and the chamber 10 closed the integrity of the seals is tested using nitrogen gas to 100 psig to verify gas pressure tightness.

The cutting head of the ammonia jet system is preferably electrically bonded (not shown) to a wall of the protective chamber to prevent the generation of static electricity. Ammoniajet cutter assembly 12 includes a spray containment shield and suction pickup 18 for collecting and transporting discharged slurry or solution of ammonia and energetics from the interior of the projectile to other work station(s) 20 for further processing, e.g., ammonia evaporation and recovery station for recompression of the ammonia and recycling the energetic material. Shield 18 may also include means for sealing ammonia jet cutter assembly 12 to the exterior surface of projectile 14 by means of an elastomeric seal or boot (not shown). Such a sealed shield and suction pickup when used can prevent the escape of fugitive ammonia fumes into the work area, and possibly eliminate the need for protective chamber 10.

Preferably, ammoniajet cutting assembly 12 and its ammoniajet stream 22 are positioned relative to work piece 14 as to optimize efficient utilization of the energy forces from the high velocity stream to penetrate or cut/sever the outer casing and then erode, fracture and dissolve any solid or composite substances, e.g., energetics, adhering to the interior surfaces of the work piece. Likewise, the ammonia jet stream is preferably positioned to generate turbulent forces 24 in the interior compartment causing rapid circulation of the liquid ammonia to facilitate the rate of contact of fresh incoming ammonia for dissolution of all solids. Similarly, the incoming ammonia jet also provides the energy for pressurizing the circulating liquid in the casing for rapid discharge of interior contents for collection by pickup 18 for further processing. Thus, in the case of a generally cylindrically shaped projectile 14 ammoniajet stream 22 should be positioned off center of the central axis of the projectile, so the jet stream enters the interior of the casing towards the sidewall more tangentially than centrally. From this representative example, it will be readily apparent to those skilled in the art how to position the cutting head of the ammonia jet on targets having diverse geometrical configurations for optimizing the washout rate.

Figure 3:
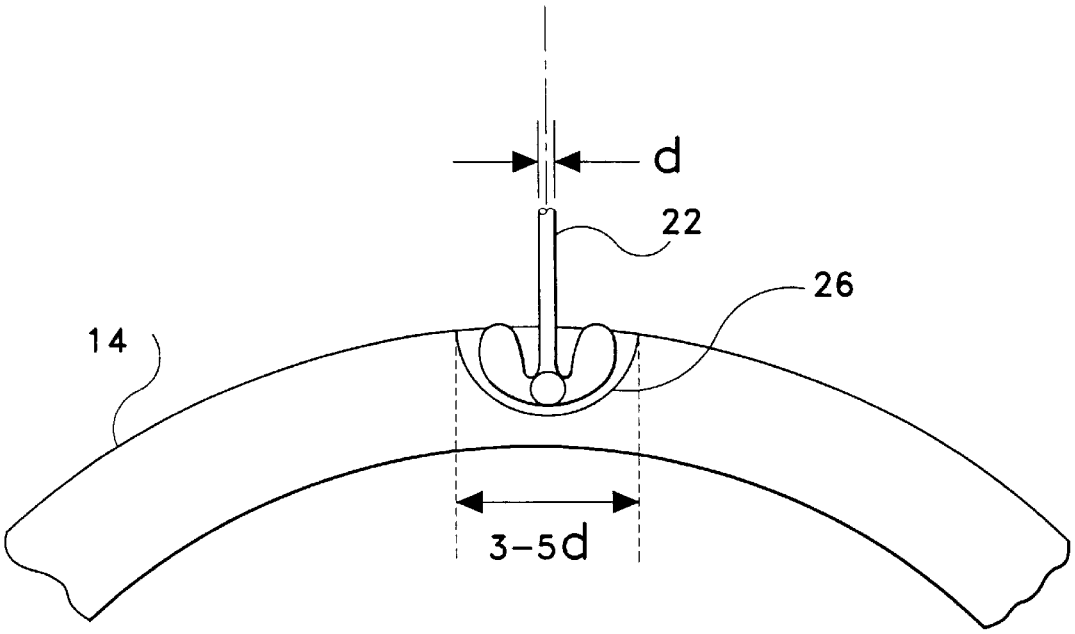
FIG. 3 is an enlarged partial view of the metallic casing taken along line 3—3 of FIG. 2, illustrating the breadth of the erosion of the target produced by the high pressure, high velocity ammonia jet stream during the cutting phase.

FIG. 3 illustrates the impingement of high pressure ammonia jet 22 at the surface of the steel casing of projectile 14 during the cutting phase. Jet stream 22 is shown having diameter (d) eroding the surface of the casing. However, the cutting action of ammonia jet produces a kerf 26 which is disproportionate to the diameter (d) of jet stream 22 due to a "mushrooming" effect of the particles of liquefied ammonia impacting the surface under extreme pressure and velocity. Advantageously, the ammonia jet produces a broaden kerf, and ultimately a breakthrough orifice in the outer casing of the projectile or other work piece for washout which is approximately 3 to about 5 times (3–5 d) the diameter (d) of jet stream 22.

Figure 4:
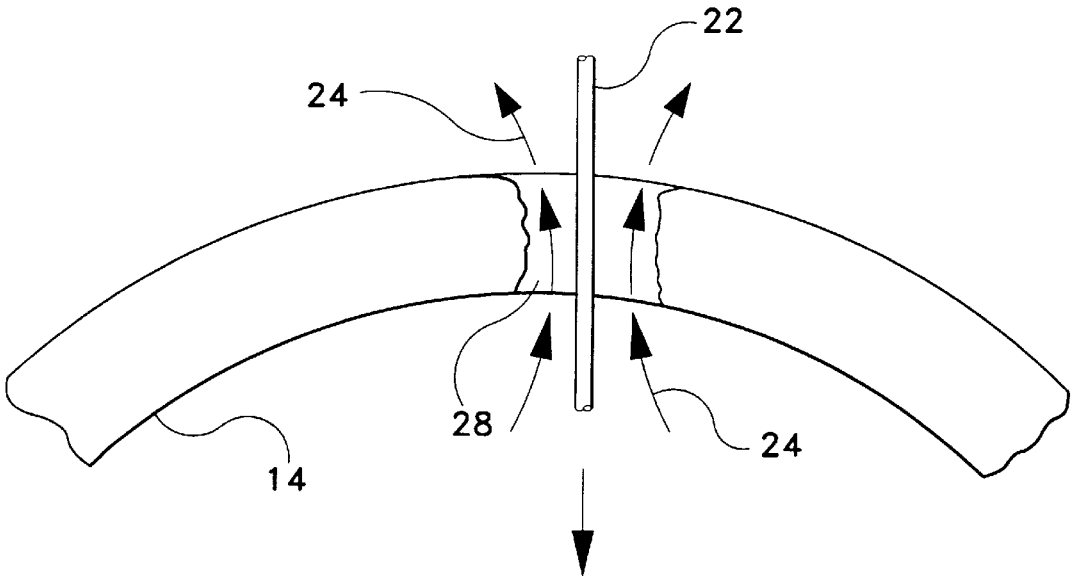
FIG. 4 is an enlarged partial view of the ammonia jet stream shown by FIG. 3 after penetration of the casing generates interior turbulence producing erosion, slurrying, and pressurized back-flow for collecting the ammonia-containing energetic slurry from the same opening thereby facilitating total clean out of the casing during the washing phase.

FIG. 4 shows continuous operation of the high pressure ammoniajet stream 22 after completion of the cutting phase wherein ammonia jet 22 continues to operate substantially as it did during the cutting phase, except that the liquid ammonia enters the interior of the work piece. The energy of the jet stream operates to erode the chemical contents under turbulent conditions mixing and slurrying the contents, dissolving the contents to the extent of their solubility in ammonia. However, because the diameter of orifice 28 is about 3 to about 5 times that of ammonia jet stream 22 entering the orifice, the present invention contemplates utilizing simultaneously the same orifice 28 as both entry port and exit port for delivering fresh ammonia as high pressure jet stream 22, and discharging the slurried contents also through orifice 28 coaxially to the incoming ammonia jet. This means greater production efficiencies in view of penetrating the casing and washing the contents therefrom being performed through a single cutting to produce only one port. This avoids the need for making separate cuts, one as the ammonia inlet port and a second as the slurry outlet port.

While FIGS. 2–4 dwell upon cutting a single access port into the casing of a munition, for example, it is to be understood the invention contemplates alternative cutting strategies inter alia multiple ports, e.g., inlet and outlet ports, as well as sectioning the entire casing with one or more cross or transverse cuts and/or longitudinal or ripping cuts for salvaging rocket motors, for instance.

The ammonia should be maintained in a liquid state during the cutting and washing phases. If, however, the ammonia is allowed to undergo a phase change to a gaseous state it will become less effective in both the cutting and washing phases, previously discussed. Handling systems for anhydrous liquid ammonia, comprising storage and supply capabilities, recovery, treatment and recompression for recycling, including means for monitoring and regulating pressures and temperatures are well known in the art. One representative example is disclosed by U.S. Pat. No. 4,854,982 (Melvin et al) which employs an ammonia handling system in connection with the demilitarization of open rocket motors. While Melvin et al are not concerned with the problem of accessing the interiors of sealed rocket motors, or high pressure liquidjet cutting as a preliminary step to demilitarization, they do disclose supply systems for anhydrous ammonia, means for extracting a chemical from open rocket motors utilizing pressurized spraying of anhydrous ammonia as the solvating medium, means for recovering chemicals from liquid ammonia, and a system for ammonia recovery. Generally, the supply and high pressure ammonia spray system comprises a liquid ammonia supply vessel, means for monitoring liquid ammonia reserves, and various accessories, e.g., in-line filter and pump for the anhydrous ammonia, flow meter, flow totalizer, back pressure regulator, preheater, check valves, pressure gauges, and so on. The system for recovering extracted oxidizer from the liquid ammonia comprises first a filtration chamber for initially separating insoluble components from the liquid ammonia-containing washings exiting the treated casings. The ammonia-oxidizer filtrate is received in an expansion vessel where it undergoes pressure reduction and conversion of the liquid ammonia to a gaseous phase whereupon the dissolved oxidizer automatically precipitates out as a solid material. The gaseous ammonia is then treated in an ammonia recovery station (ARS) where it is dried in an appropriate column to remove any residual moisture and filtered. The anhydrous gaseous ammonia is then recompressed in an appropriate ammonia recompression pump and returned to the supply tank for reuse. More specific details of the disclosures of U.S. Pat. No. 4,854,982 are hereby incorporated-by-reference herein, and made part of this disclosure.

In preparing solvated electrons for the destruction phase of this process irrespective of whether the destruction of the hazardous material, e.g., EM, is carried out in its native container, in a dedicated reactor system, at least two moles of solvated electrons are ordinarily required for every mole of the EM to be destroyed if a covalent bond is to be broken. This follows since it is believed that two moles of solvated electrons are required to break a covalent chemical bond. On the other hand, it may be beneficial to employ excess solvated electrons, that is, sufficient solvated electrons to break as many as perhaps about two to four bonds, or more, in the EM, for example. The products resulting from the more extensive reaction of the EM can be easier to handle from a safety and/or environmental point of view.

In the event the EM is found in a munition which includes CWA which is also to be destroyed, it will be evident that the quantities of anhydrous ammonia and active metal must be adjusted to recognize the presence of the CWA, if both the EM and the CWA are to be destroyed. In general terms, the ratios in amounts of the various components of the reaction mixture are similar regardless of whether an EM or CWA is being reacted. Thus, the amounts of EM and CWA to be destroyed generally can simply be added together, and the amounts of the other components of the reaction mixture readily calculated from the ratios provided below.

An active metal in an amount which is at least sufficient to destroy the hazardous substances(s) is added to a closed vessel with the ammonia-containing washings comprising the extracted hazardous substance(s), and then reacted. With regard to the active metal to be employed in the methods of this invention, whereas the literature reports the use of a number of other metals, such as Mg, Al, Fe, Sn, Zn, and alloys thereof in dissolving metal reductions, in this aspect of the invention, it is preferred that the active metal be selected from one or a combination of the metals found in Groups IA and IIA of the Periodic Table of Elements; that is, the alkali and alkaline earth metals. Largely for reasons of availability and economy, it is most preferred that the active metal be selected from Li, Na, K, Ca, and mixtures thereof. In most cases, the use of sodium, which is widely available and inexpensive, will prove to be satisfactory.

Although other conditions can sometimes be employed to advantage, this aspect of the invention is preferably carried out at a temperature in the range of about −35° C. to about 50° C. and, although the reaction can be carried out at subatmospheric pressure, it is preferred that the method be performed in the pressure range of about atmospheric pressure to about 21 $Kg/cm^2$ (300 psi). More preferably, the reaction is carried at about room temperature, e.g., about 20° C. (68° F.), under a pressure of about 9.1 $Kg/cm^2$ (129 psi).

In this phase of the invention, the ratio of anhydrous ammonia/hazardous substance, e.g., EM in the reaction mixture is preferably between about 1/1 to about 10,000/1 on a weight/weight basis, more preferably between about 10/1 and 1000/1, and most preferably, between about 100/1 and about 1000/1.

The amount of active metal should preferably be in the range of about 0.1 percent to about 12 percent by weight based on the weight of the mixture, and more preferably, between about 2 percent and about 10 percent.

On a metal weight/hazardous substance weight basis the reaction mixture preferably contains between about 0.1 and 2.0 times as much metal as hazardous substance, more preferably between about 0.15 and about 1.5 times as much, and most preferably between about 0.2 and about 1.0 as much metal as hazardous substance. As previously mentioned, where active metal is employed, on a molar basis the reaction mixture should contain not less than 2 moles of the active metal per mole of hazardous substance, if destruction of the hazardous substance requires that a covalent bond be broken. If the destruction requires breaking an ionic bond, as in a salt, active metal in molar amount at least equal to the molar amount of the hazardous substance multiplied by the positive charge formally exhibited by the cationic component of electron bond should be employed.

The course of the reaction involving solvated electrons can be followed readily by monitoring the blue color of the reaction mixture which is characteristic of solutions of anhydrous ammonia and active metal, that is, solvated electrons. When the blue color disappears, it is a signal that the EM, CWA or other hazardous substance has reacted with all of the solvated electrons, and more active metal or solution containing solvated electrons can be added to ensure that at least the stoichiometrically necessary amount of active metal has reacted per mole of hazardous substance. In many cases it is preferred that the addition of active metal or additional solvated electrons be continued until the hazardous substance has completely reacted with the solvated electrons, a state which is signaled when the blue color of the mixture remains. The rate of the reaction between the hazardous substance and solvated electrons is rapid, the reaction in most cases being substantially complete in a matter of minutes to a few hours.

Dissolving metal reduction chemistry is not new; it is embodied in the well known "Birch Reduction," which was first reported in the technical literature in 1944. The Birch Reduction itself is a method for reducing aromatic rings by means of alkali metals in liquid ammonia to give mainly the dihydro derivatives; see, for example, "*The Merck Index,*" 12th Ed., Merck & Co., Inc., Whitehouse Station, N.J., 1996, p. ONR-10.

Such dissolving metal reductions have been the subject of much further investigation and numerous publications.

Reviews include the following: G. W. Watt, *Chem. Rev.,* 46, 317–379 (1950) and M. Smith, "*Dissolving Metal Reductions,*" in "*Reduction: Techniques and Applications in Organic Synthesis,*" ed. R. L. Augustine, Marcel Decker, Inc., New York, N.Y., 1968, pages 95–170. Dissolving metal reduction chemistry is applicable to compounds containing a wide range of functional groups.

For example, alkylnitro compounds can be reduced to the corresponding alkylhydroxylamines with sodium and liquid ammonia; see M. Smith, cited above, p. 115, and aromatic nitro compounds can be reduced to the corresponding amines with a lithium/amine reagent; see, R. Benkeser and coworkers, *J. Am. Chem Soc.,* 80, 6593 (1958) and G. Watt, cited above, p. 356. The overall reaction from —$NO_2$ to —$NH_2$ requires 6 moles of active metal, for example Na, per mole of —$NO_2$; 2 moles of metal per mole of $_2$—NO produce the corresponding hydroxylamine, —NHOH. Dinitrocellulose is reported to yield an amine derivative when treated with sodamide in liquid ammonia; see P. Scherer and coworkers, *Rayon Textile Monthly,* 28 72 (1947); CA 2101f (1948). Very little technical literature is available which describes the dissolving metal reduction of compounds with more than one nitro group.

An unanticipated benefit of dealing with the destruction of, not only an EM, but with a combination of EM and CWA ("EM/CWA" hereinafter), or other mixtures of hazardous materials which are not necessarily EMs or CWAs, when that is the case, is that the techniques applicable to destroy CWA's alone are also applicable to the destruction of EM's. As a consequence, and of great utility is the fact that, in the demilitarization of CWA's in close proximity to the very same EM's intended to deliver the weapons and propel the CWA's from the warheads, casings, shells, or other containments to their ultimate destination, it is possible to treat both the CWA and the EM components of the munitions simultaneously with the same reagent and at the same time, thereby providing substantial savings in the cost and complexity of the demilitarization.

Solvated electrons, unlike other species-specific reagents, are capable of performing as powerful reducing agents with respect to an extensive range of EM's, converting the organic compounds to salts or covalently bonded compounds and converting inorganics to free metals and/or by-products which are significantly lower in shock-sensitivity than the EM reactants. The resulting products are amenable to further treatment, if desired.

It is usually easier to create the solvated electrons which are required to carry out the preferred process of this invention by chemical means, such as the reaction between the anhydrous ammonia containing the EM and active metal. That is to say, the reactive metal needed to dissolve in the anhydrous ammonia can be introduced into the ammonia washings containing the hazardous substance whereby the ammoniated electrons are formed in-situ in the presence of the EM and/or CWA. The electrons in the reaction mixture are then available for immediately chemically reducing the hazardous substances to simpler substances. Likewise, solvated electrons can be formed outside the reaction zone containing the ammonia washings and hazardous substances from the cutting and washing phases be dissolving the same reactive metals in a fresh solution of anhydrous ammonia and combining with the ammonia washings and hazardous substance.

The destruction of an EM and/or CWA in this phase of the invention can be performed regardless of the source of the solvated electrons. For example, it is known that solvated electrons can be produced electrochemically in accordance with U.S. Pat. No. 4,853,040, and utilized in chemical reduction reactions. It is usually easier, however, to create the solvated electrons by chemical means, such as the reaction between the anhydrous ammonia containing the EM and active metal.

As previously indicated, the anhydrous ammonia is also the solvent of choice in the dissolving metal reaction in forming solvated electrons. It is readily available, since it is widely used as a fertilizer in agricultural applications, and relatively inexpensive. In some instances, however, it may be desirable to utilize ammonia with another solvating substance, such as an ether, for example, tetrahydrofuran, diethyl ether, dioxane, or 1,2-dimethoxyethane, or a hydrocarbon; for example, pentane, decane, and so forth. In selecting a cosolvent to be included with the ammonia it should be borne in mind that solvated electrons are extremely reactive, so it is preferred that any cosolvent included not contain groups which compete with the hazardous substance being destroyed, to assure the solvated electrons react with the hazardous substance(s) only. Such competing groups include, for example, aromatic hydrocarbon groups which may undergo the Birch reduction, and acid, hydroxyl, sulfide, halogen, and ethylenic unsaturation. They should, in general, be avoided unless they are contained in the substance to be destroyed so as to prevent undesirable side reactions which consume reactants unprofitably. Water should also be avoided, although water can sometimes be effectively utilized in the product work-up. As an exception, at the completion of the process, any residual, excess, or unreacted active metal, e.g. sodium, in the reaction can be quenched by adding an alcohol, such is isopropanol, to the reaction mixture prior to removing the ammonia. Water can also be used to react with an residual sodium metal or eliminate excess solvated electrons at the completion of the reaction.

Following the initial destruction of the hazardous material using solvated electrons, an optional step may be performed whereby the residual by-product mixture from the reduction reaction is oxidized by reacting with an oxidant. Preferably, however, before introducing the oxidant, residual ammonia is removed from the mixture by allowing remaining vapors to evaporate, such as by a reduction in head pressure. Representative oxidants and mixtures of oxidants which may be employed include hydrogen peroxide, ozone, dichromates and permanganates of alkali metals, and so on. In carrying out this additional step optimally, the process requires introducing into the reactor system or native container containing the by-product residue a sufficient amount of a suitable oxidizing agent to completely react with any residual organic products remaining from the initial reaction with the solvated electrons or anhydrous ammonia. The purpose of this oxidation step is to take any residual organic moieties to their highest possible oxidation states, and if reasonably achievable, to carbon dioxide and water.

Hence, if post-destruction oxidation is to be employed, the hazardous material, e.g., EM or EM/CWA combination is first reacted with the anhydrous ammonia, including solvated electrons when needed, followed by a secondary treatment step which comprises reacting the residuals with an oxidizing agent.

The methods of the invention, and particularly the destruction phase of the invention using solvated electrons can be performed either in a batch or continuous process. A system for treating CWA's alone or together with EM's using ammonia and/or solvated electrons is disclosed in WO 97/18858, published May 29, 1997, and application PCT/

US97/22731, filed Dec. 12, 1997, the contents of both are incorporated herein by reference.

As previously mentioned, the destruction of the hazardous substance, e.g., EM and/or CWA, may be performed in the native container, particularly in those instances when there is a sufficient volume of unoccupied space remaining to accommodate the reactants required for performing the process. Likewise, the container housing the hazardous substances should be in suitable condition for conducting the reaction. A container which has been in storage for decades or which has been buried in the ground, in some cases, since the days of World War I or before, or which was simply discarded for burial in a dump or landfill, and has undergone corrosion may not be in suitable condition to be employed as a reaction vessel. The difficulty arises not because the hazardous substance may be decomposed, but because the containment may not provide sufficient physical integrity to hold the reaction mixture. Solvated electrons are not only useful in the destruction of EM's which are still primarily in the state in which they were produced, but surprisingly, also in the demilitarization of EM's contained in explosives or propellants which have deteriorated over a number of years in storage. Such explosives or propellants may by now have been transformed from their original state into products of unknown composition, toxicity and shock-sensitivity.

The invention may also be performed in a reactor or reactor system suitable for accommodating original native containers which may have an insufficient volume of unoccupied space to allow for the introduction of the required amount of nitrogenous base or externally-produced solution of solvated electrons, or are in such poor physical condition as not to be able to contain and confine the reaction mixture. In these cases, destruction of the hazardous substances can be carried out by opening the native containers, or sectioning them using the high pressure ammoniajet or abrasive ammoniajet in accordance with the protocols disclosed above, and placing the opened or severed containment parts with their hazardous contents in a larger dedicated reactor system or reaction vessel for purposes of destroying the hazardous materials. Using this procedure, both the EM and/or CWA and the native containers can be simultaneously treated.

While the invention has been described in conjunction with various embodiments, they are illustrative only. Accordingly, many alternatives, modifications and variations will be apparent to persons skilled in the art in light of the foregoing detailed description, and it is therefore intended to embrace all such alternatives and variations as to fall within the spirit and broad scope of the appended claims.

I claim:

1. A method for destroying a solid explosive confined in a target containment, which comprises the steps of:

(i) providing a system suitable for impinging a high pressure jet of a liquid from a cutting head onto a target containment at sufficient velocity to disperse or dissolve the solid explosive;

(ii) positioning in a work area said target containment adjacent to said cutting head of the system;

(iii) shielding said target containment and cutting head from said work area;

(iv) impinging a high pressure jet comprising anhydrous liquid ammonia from said cutting bead onto said solid explosive to form an ammonia-containing slurry or solution of said solid explosive, and (v) forming a reaction mixture comprising said ammonia-containing slurry or solution of said solid explosive and solvated electrons, and reacting the reaction mixture.

2. A method for destroying a solid explosive confined in a target containment, which comprises the steps of:

(i) providing a system suitable for impinging a high pressure ammoniajet cutting fluid or abrasive-ammoniajet cutting fluid mixture from a cutting head onto a closed target containment having an interior compartment at sufficient velocity to penetrate or cut said target containment;

(ii) positioning in a work area said target containment adjacent to the cutting head of said system;

(iii) shielding said target containment and cutting head from said work area;

(iv) impinging the high pressure ammoniajet cutting fluid or abrasive-ammoniajet cutting fluid mixture to penetrate and/or cut said target containment for accessing said interior compartment;

(v) forming a slurry of the solid explosive with the assistance of said high pressure ammoniajet cutting fluid or the abrasive-ammoniajet cutting fluid mixture entering the compartment after break through of the containment, and (vi) destroying the solid explosive by forming a reaction mixture comprising the ammonia-containing slurry or solution of said solid explosive and solvated electrons, and reacting said reaction mixture.

3. A method for destroying a solid explosive confined in a target containment as recited in claim 1, wherein the high pressure jet further includes a surfactant.

4. A method for destroying a solid explosive confined in a target containment as recited in claim 1, wherein the anhydrous liquid ammonia is at least 99.5% ammonia.

5. A method for destroying a solid explosive confined in a target containment as recited in claim 4, wherein the anhydrous liquid ammonia is at least 99.7% ammonia.

6. A method for destroying a solid explosive confined in a target containment as recited in claim 1, wherein the anhydrous liquid ammonia has been filtered down to 5 microns.

7. A method for destroying a solid explosive confined in a target containment as recited in claim 1, wherein the cutting head includes multiple orifices for the high pressure jet.

8. A method for destroying a solid explosive confined in a target containment as recited in claim 1, further including electrically bonding the system to the work area so as to prevent generation of static electricity.

9. A method for destroying a solid explosive confined in a target containment as recited in claim 1, further including providing a shield for sealing the cutting head to the target containment.

10. A method for destroying a solid explosive confined in a target containment as recited in claim 1, wherein the reaction mixture is reacted at a temperature in a range of about −35° C. to about 50° C.

11. A method for destroying a solid explosive confined in a target containment as recited in claim 1, wherein the reaction mixture is reacted under a pressure range of about atmospheric pressure to about 21 $Kg/cm^2$.

12. A method for destroying a solid explosive confined in a target containment as recited in claim 1, wherein the reaction mixture is reacted at a temperature of about 20° C. and under a pressure of about 9.1 $Kg/cm^2$.

13. A method for destroying a solid explosive confined in a target containment as recited in claim 1, wherein a ratio of the anhydrous ammonia to the solid explosive in the reaction mixture ranges from about 1/1 to about 10,000/1 on a weight/weight basis.

14. A method for destroying a solid explosive confined in a target containment as recited in claim 13, wherein the ratio of the anhydrous ammonia to the solid explosive in the reaction mixture ranges from about 10/1 to about 1000/1 on a weight/weight basis.

15. A method for destroying a solid explosive confined in a target containment as recited in claim 14, wherein the ratio of the anhydrous ammonia to the solid explosive in the reaction mixture ranges from about 100/1 to about 1000/1 on a weight/weight basis.

16. A method for destroying a solid explosive confined in a target containment as recited in claim 1, wherein the reaction mixture is formed by mixing the ammonia-containing slurry or solution of solid explosive with a solution of solvated electrons.

17. A method for destroying a solid explosive confined in a target containment as recited in claim 1, wherein the reaction mixture is formed by dissolving at least one reactive metal in the ammonia-containing slurry or solution of solid explosive.

18. A method for destroying a solid explosive confined in a target containment as recited in claim 17, wherein the at least one reactive metal is selected from the group consisting of lithium, sodium, potassium, and calcium.

19. A method for destroying a solid explosive confined in a target containment as recited in claim 17, wherein the at least one reactive metal is sodium.

20. A method for destroying a solid explosive confined in a target containment as recited in claim 17, wherein the amount of reactive metal in the reaction mixture ranges from about 0.1% to about 12% by weight based on the weight of the reaction mixture.

21. A method for destroying a solid explosive confined in a target containment as recited in claim 20, wherein an amount of reactive metal in the reaction mixture ranges from about 2% to about 10% by weight based on a weight of the reaction mixture.

22. A method for destroying a solid explosive confined in a target containment as recited in claim 17, wherein a ratio of reactive metal to the solid explosive in the reaction mixture ranges from about 0.1/1 to about 2.0/1 on a weight/weight basis.

23. A method for destroying a solid explosive confined in a target containment as recited in claim 22, wherein the ratio of reactive metal to the solid explosive in the reaction mixture ranges from about 0.15/1 to about 1.5/1 on a weight/weight basis.

24. A method for destroying a solid explosive confined in a target containment as recited in claim 23, wherein the ratio of reactive metal to the solid explosive in the reaction mixture ranges from about 0.2/1 to about 1.0/1 on a weight/weight basis.

25. A method for destroying a solid explosive confined in a target containment as recited in claim 17, wherein the reaction mixture further includes a solvent for dissolving said at least one reactive metal.

26. A method for destroying a solid explosive confined in a target containment as recited in claim 25, wherein the solvent is an ether or a hydrocarbon.

27. A method for destroying a solid explosive confined in a target containment as recited in claim 1, wherein the reaction mixture is formed in a dedicated reactor.

28. A method for destroying a solid explosive confined in a target containment as recited in claim 1, wherein the reaction mixture is formed in-situ.

29. A method for destroying a solid explosive confined in a target containment as recited in claim 1, further including the step of mixing a residual by-product of the reaction mixture with an oxidant.

30. A method for destroying a solid explosive confined in a target containment as recited in claim 1, further including the step of removing residual ammonia from a residual by-product of the reaction mixture.

31. A method for destroying a solid explosive confined in a target containment as recited in claim 1, wherein the high pressure jet liquid is expelled from the cutting head with a pressure in the range of about 30,000 psi to 150,000 psi.

32. A method for destroying a solid explosive confined in a target containment as recited in claim 31, wherein the high pressure jet liquid is expelled from the cutting head with a pressure in the range of about 40,000 psi to 100,000 psi.

33. A method for destroying a solid explosive confined in a target containment as recited in claim 2, wherein the high pressure jet further includes a surfactant.

34. A method for destroying a solid explosive confined in a target containment as recited in claim 2, wherein the ammonia is at least 99.5% ammonia.

35. A method for destroying a solid explosive confined in a target containment as recited in claim 34, wherein the ammonia is at least 99.7% ammonia.

36. A method for destroying a solid explosive confined in a target containment as recited in claim 2, wherein the ammonia has been filtered down to 5 microns.

37. A method for destroying a solid explosive confined in a target containment as recited in claim 2, wherein the cutting head includes multiple orifices for the high pressure jet.

38. A method for destroying a solid explosive confined in a target containment as recited in claim 2, further including electrically bonding the system to the work area so as to prevent generation of static electricity.

39. A method for destroying a solid explosive confined in a target containment as recited in claim 2, further including providing a shield for sealing the cutting head to the target containment.

40. A method for destroying a solid explosive confined in a target containment as recited in claim 2, wherein the reaction mixture is reacted at a temperature in a range of about −35° C. to about 50° C.

41. A method for destroying a solid explosive confined in a target containment as recited in claim 2, wherein the reaction mixture is reacted under a pressure range of about atmospheric pressure to about 21 $Kg/cm^2$.

42. A method for destroying a solid explosive confined in a target containment as recited in claim 2, wherein the reaction mixture is reacted at a temperature of about 20° C. and under a pressure of about 9.1 $Kg/cm^2$.

43. A method for destroying a solid explosive confined in a target containment as recited in claim 2, wherein a ratio of the ammonia to the solid explosive in the reaction mixture ranges from about 1/1 to about 10,000/1 on a weight/weight basis.

44. A method for destroying a solid explosive confined in a target containment as recited in claim 43, wherein the ratio of the ammonia to the solid explosive in the reaction mixture ranges from about 10/1 to about 1000/1 on a weight/weight basis.

45. A method for destroying a solid explosive confined in a target containment as recited in claim 44, wherein the ratio of the ammonia to the solid explosive in the reaction mixture ranges from about 100/1 to about 1000/1 on a weight/weight basis.

46. A method for destroying a solid explosive confined in a target containment as recited in claim 2, wherein the reaction mixture is formed by mixing the ammonia-containing slurry or solution of solid explosive with a solution of solvated electrons.

47. A method for destroying a solid explosive confined in a target containment as recited in claim 2, wherein the reaction mixture is formed by dissolving at least one reactive metal in the ammonia-containing slurry or solution of solid explosive.

48. A method for destroying a solid explosive confined in a target containment as recited in claim 47, wherein the at least one reactive metal is selected from the group consisting of lithium, sodium, potassium, and calcium.

49. A method for destroying a solid explosive confined in a target containment as recited in claim 47, wherein the at least one reactive metal is sodium.

50. A method for destroying a solid explosive confined in a target containment as recited in claim 47, wherein an amount of reactive metal in the reaction mixture ranges from about 0.1% to about 12% by weight based on a weight of the reaction mixture.

51. A method for destroying a solid explosive confined in a target containment as recited in claim 50, wherein the amount of reactive metal in the reaction mixture ranges from about 2% to about 10% by weight based on the weight of the reaction mixture.

52. A method for destroying a solid explosive confined in a target containment as recited in claim 47, wherein a ratio of reactive metal to the solid explosive in the reaction mixture ranges from about 0.1/1 to about 2.0/1 on a weight/weight basis.

53. A method for destroying a solid explosive confined in a target containment as recited in claim 52, wherein the ratio of reactive metal to the solid explosive in the reaction mixture ranges from about 0.15/1 to about 1.5/1 on a weight/weight basis.

54. A method for destroying a solid explosive confined in a target containment as recited in claim 53, wherein the ratio of reactive metal to the solid explosive in the reaction mixture ranges from about 0.2/1 to about 1.0/1 on a weight/weight basis.

55. A method for destroying a solid explosive confined in a target containment as recited in claim 47, wherein the reaction mixture further includes a solvent for dissolving the at least one reactive metal.

56. A method for destroying a solid explosive confined in a target containment as recited in claim 55, wherein the solvent is an ether or a hydrocarbon.

57. A method for destroying a solid explosive confined in a target containment as recited in claim 2, wherein the reaction mixture is formed in a dedicated reactor.

58. A method for destroying a solid explosive confined in a target containment as recited in claim 2, wherein the reaction mixture is formed in-situ.

59. A method for destroying a solid explosive confined in a target containment as recited in claim 2, further including the step of mixing a residual by-product of the reaction mixture with an oxidant.

60. A method for destroying a solid explosive confined in a target containment as recited in claim 2, further including the step of removing residual ammonia from a residual by-product of the reaction mixture.

61. A method for destroying a solid explosive confined in a target containment as recited in claim 60, further including the step of mixing the residual by-product of the reaction mixture with an oxidant.

62. A method for destroying a solid explosive confined in a target containment as recited in claim 2, wherein the high pressure ammoniajet cutting fluid is expelled from the cutting head with a pressure in the range of about 30,000 psi to 150,000 psi.

63. A method for destroying a solid explosive confined in a target containment as recited in claim 62, wherein the high pressure ammonia jet cutting fluid is expelled from the cutting head with a pressure in the range of about 40,000 psi to 100,000 psi.

64. A method for destroying a solid explosive confined in a target containment as recited in claim 2, wherein the abrasive-ammoniajet cutting fluid mixture includes an abrasive having a size of 80 mesh or smaller.

65. A method for destroying a solid explosive confined in a target containment as recited in claim 2, wherein the abrasive-ammoniajet cutting fluid mixture includes an abrasive having a size from 80 mesh to 1000 mesh.

66. A method for destroying a solid explosive confined in a target containment as recited in claim 65, wherein the abrasive has a size from 80 mesh to 150 mesh.

67. A method for destroying a solid explosive confined in a target containment as recited in claim 2, wherein the abrasive-ammoniajet cutting fluid mixture includes an abrasive selected from the group consisting of almondine garnet, steel shot, glass, and silica.

68. A method for destroying a solid explosive confined in a target containment as recited in claim 2, wherein the abrasive-ammoniajet cutting fluid mixture includes an abrasive of almondine garnet.

69. A method for destroying a solid explosive confined in a target containment as recited in claim 2, wherein the abrasive-ammoniajet cutting fluid mixture is formed when the ammonia passes through the cutting head so as to entrain abrasive particles by aspiration and mix the particles by mechanical action.

70. A method for destroying a solid explosive confined in a target containment as recited in claim 69, wherein the high pressure abrasive ammoniajet cutting fluid is expelled from the cutting head with a pressure in the range of about 20,000 psi to 75,000 psi.

71. A method for destroying a solid explosive confined in a target containment as recited in claim 70, wherein the high pressure abrasive ammoniajet cutting fluid is expelled from the cutting head with a pressure in the range of about 20,000 psi to 60,000 psi.

72. A method for destroying a solid explosive confined in a target containment as recited in claim 2, further including separating abrasive particles from the ammonia-containing slurry or solution of the solid explosive.

73. A method for destroying a solid explosive confined in a target containment as recited in claim 2, wherein a ratio of abrasive to ammonia in the high pressure abrasive ammonia jet cutting fluid is about 13%.

74. A method for destroying a solid explosive confined in a target containment as recited in claim 2, wherein a ratio of abrasive to ammonia in the high pressure abrasive ammonia jet cutting fluid ranges from 17% to 20%.

* * * * *